United States Patent [19]

Huhn et al.

[11] 4,046,992

[45] Sept. 6, 1977

[54] COMPACT ELECTRONIC VOTING

[76] Inventors: Mary Susan Huhn, 38 Ridgewood Ave., Groton, Mass. 01450; Paul Horowitz, 19 Fair Oaks Drive, Lexington, Mass. 02173; Winfield Hill, 165 Hunnewell Ave., Newton, Mass. 02158

[21] Appl. No.: 663,839

[22] Filed: Mar. 4, 1976

[51] Int. Cl.[2] ..... G07C 13/00

[52] U.S. Cl. ..... 235/54 F; 235/55 R

[58] Field of Search ..... 235/51, 52, 54 F, 55 R

[56] References Cited

U.S. PATENT DOCUMENTS

| | | | |
|---|---|---|---|
| 3,710,105 | 1/1973 | Oxendine, Jr. et al. | 235/54 F |
| 3,739,151 | 6/1973 | Moldovan, Jr. et al. | 235/54 F |
| 3,904,854 | 9/1975 | Smith, Jr. | 235/54 F |

*Primary Examiner*—E. S. Jackmon

*Attorney, Agent, or Firm*—Charles Hieken; Jerry Cohen

[57] ABSTRACT

A portable electronic voting machine suitable for use in simple elections includes a number of spring-loaded switches normally centered and movable upward to a vote position to select a candidate and downward to an erase position to erase a previous selection that has not yet been entered with a light above each switch indicating the state of selection. An n of m counter settable prior to the election to the maximum number of votes that may be cast by a voter and associated logical circuitry prevents more than that selected number from being entered by a single voter. An election official operates a voter enable switch to light a ready light and enables the apparatus to receive vote selections. Upon completing selections, the voter presses a register votes switch to enter the votes in associated electromechanical candidate counters if the number is less than the maximum and safety devices indicate an absence of potential safety problems while illuminating a green light to indicate the votes have been recorded. Each selection is stored in a candidate flip-flop with the candidate flip-flops sequentially scanned to advance the associated counter. A no vote candidate gate counter records the number of blanks, a protective counter records the number of voters that have voted on the machine for its life and a public counter records the number voting in that election.

8 Claims, 7 Drawing Figures

NOTES:

1. ALL PULLUP RESISTORS 3.3K
2. NOTE Vcc, GND ON 7493

COMPACT ELECTRONIC VOTING

BACKGROUND OF THE INVENTION

The present invention relates in general to automatic voting and more particularly concerns novel apparatus and techniques suitable for use in relatively simple elections for operation by relatively unsophisticated voters of reliable secure portable apparatus. An exemplary embodiment of the invention for handling small elections with as many as sixteen candidates for a single office weighs but twenty pounds.

An example of the prior art is the Automatic Voting Machine voting machine developed for Venezuela described in U.S. Pat. Nos. 3,739,151 and 3,847,345. The actual machine provides means for voting for one-in-two offices, weighs 85 pounds and includes a microprocessor semiconductor chip. Aronson U.S. Pat. No. 3,125,289 is also representative of the prior art.

It is an important object of the invention to provide an improved simplified voting machine.

It is another object of the invention to achieve the preceding object with a machine that is reliable, secure and portable.

It is a further object of the invention to achieve one or more of the preceding objects with apparatus that is easy to use by unsophisticated voters.

It is a further object of the invention to achieve one or more of the preceding objects with apparatus capable of accepting a number of acceptable votes for an office, such as selecting a board of directors for a poverty organization.

It is a further object of the invention to achieve one or more of the preceding objects with apparatus that is relatively easy to safely supervise by an election official and is relatively tamperproof.

It is a further object of the invention to achieve one or more of the preceding objects with apparatus that is relatively easy and inexpensive to fabricate while operating reliably.

SUMMARY OF THE INVENTION

According to the invention, there is an *n* of *m* counter for establishing the number of acceptable votes, and a candidate switch associated with each candidate together with an associated bistable element, such as flip-flop, that is set to store a vote and reset to erase it, means responsive to a voter indicating completion of vote selections for scanning the bistable elements to provide an indication of the number of selections made, means for comparing the latter number with the maximum number of acceptable votes to provide a good signal if less than or equal to the acceptable number and a bad signal if over that number, means responsive to the good signal for sequentially advancing those candidate counters assocated with a candidate then selected, and means responsive to a bad signal for providing an indication to the voter that the votes have not been entered and preventing advancement of the candidate counters. According to a preferred form of the invention, there is means for counting the number of blank votes. Numerous other features, objects and advantages of the invention will become apparent from the following specification when read in connection with the accompanying drawing in which:

DETAILED DESCRIPTION OF PREFERRED EMBODIMENTS

Figure 1:
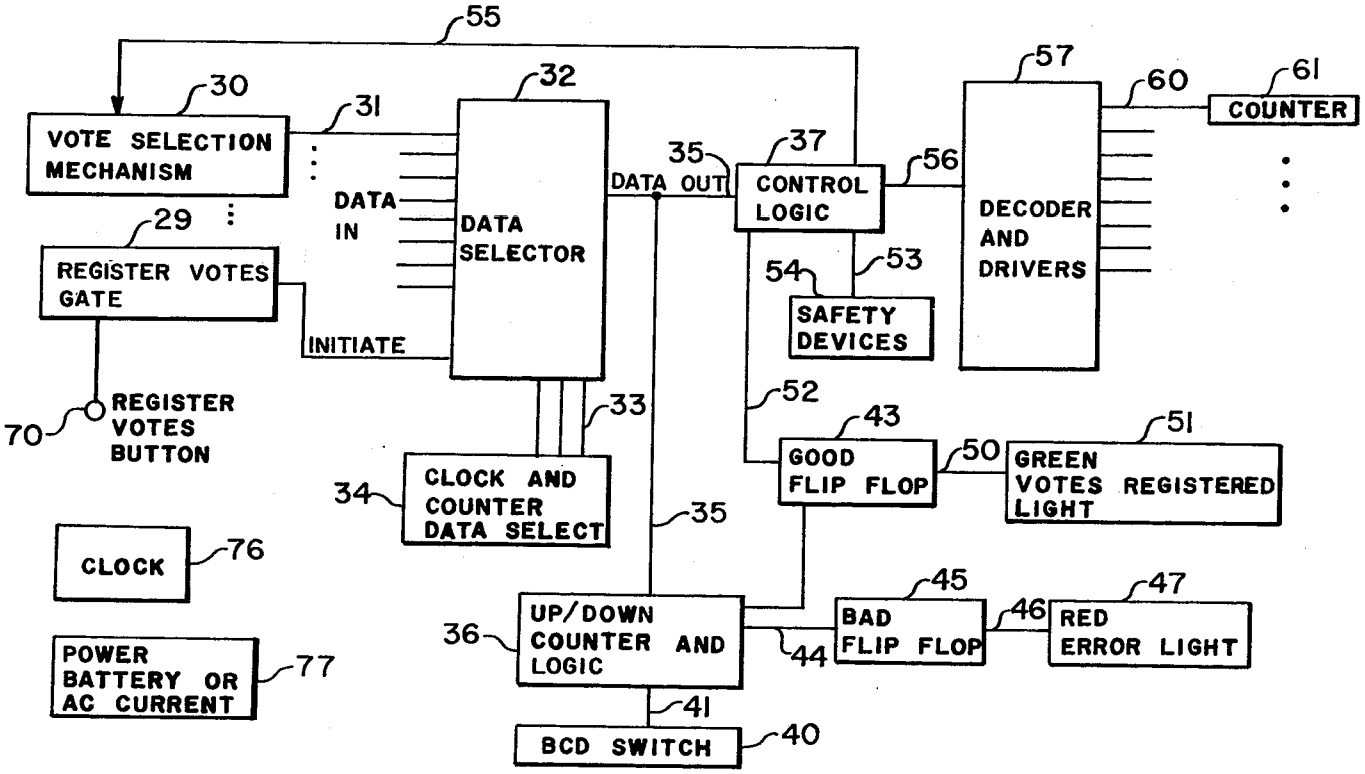
FIG. 1 is a block diagram illustrating the logical arrangement of a voting machine according to the invention.

With reference now to the drawing and more particularly FIG. 1 thereof, there is shown a block diagram illustrating the logical arrangement of a system according to the invention. Vote selection mechanism 30 allows a voter to make selections that are counted by candidate counters 61 when the voter pushes register votes button 70 if the votes are legal. Vote selection mechanism 30 provides vote signals on line 31 to data selector 32 controlled by signals on line 33 from clock and counter data select 34 to provide vote signals on line 35 in response to an initiate signal from register votes gate 29. The signals on a data output line 35 are delivered to up/down counter and logic 36 for advancing and retarding the count in accordance with selecting and erasing votes for effectively comparing the votes selected with a maximum vote count set before the election with BCD switch 40 coupled over line 41 to provide a good signal delivered to good flip-flop 43 that enables control logic 37 on line 52 to transmit the data output over line 56 to decoder and drivers 57 that provide outputs on lines 60 in sequence to counters 61 to record the good votes cast, the blanks, the voters so far in this election and the voters so far for the specific machine. Good flip-flop 43 also delivers illuminating energy over line 50 to the green votes registered light 51 to inform the voter that his votes have been recorded. Absence of a good signal on line 52 from good flip-flop 43 prevents control logic 37 from transmitting the data to decoder and drivers 57 for counting. Similarly the presence of an inhibiting signal on line 53 from safety devices 54 indicating the possibility of tampering prevents control logic 37 from delivering vote signals for aaccumulation in candidate counters 61.

If the number of unerased vote signals on line 35 exceeds the legal number set for that election, up/down counter and logic 36 provides a signal on line 44 that sets bad flip-flop 45 to provide an illuminating signal on line 46 to red error light 47 to indicate that the votes have not been registered and that the voter should reduce the number of selections.

The absence of an inhibit signal on line 53 and the occurrence of a good signal on line 52 causes control logic 37 to provide a disable signal on line 55 that prevents further selection of or erasure of votes for that voter.

The various operations occur in synchronism with clock pulses provided by clock 76, and system components receive power from power supply 77 that may be a battery or an a-c supply that provides the necessary d-c potentials. Those skilled in the art are familiar with using a clock and power supply in apparatus of this type and specific connections from them are omitted to avoid obscuring the other signal paths.

Figure 2:
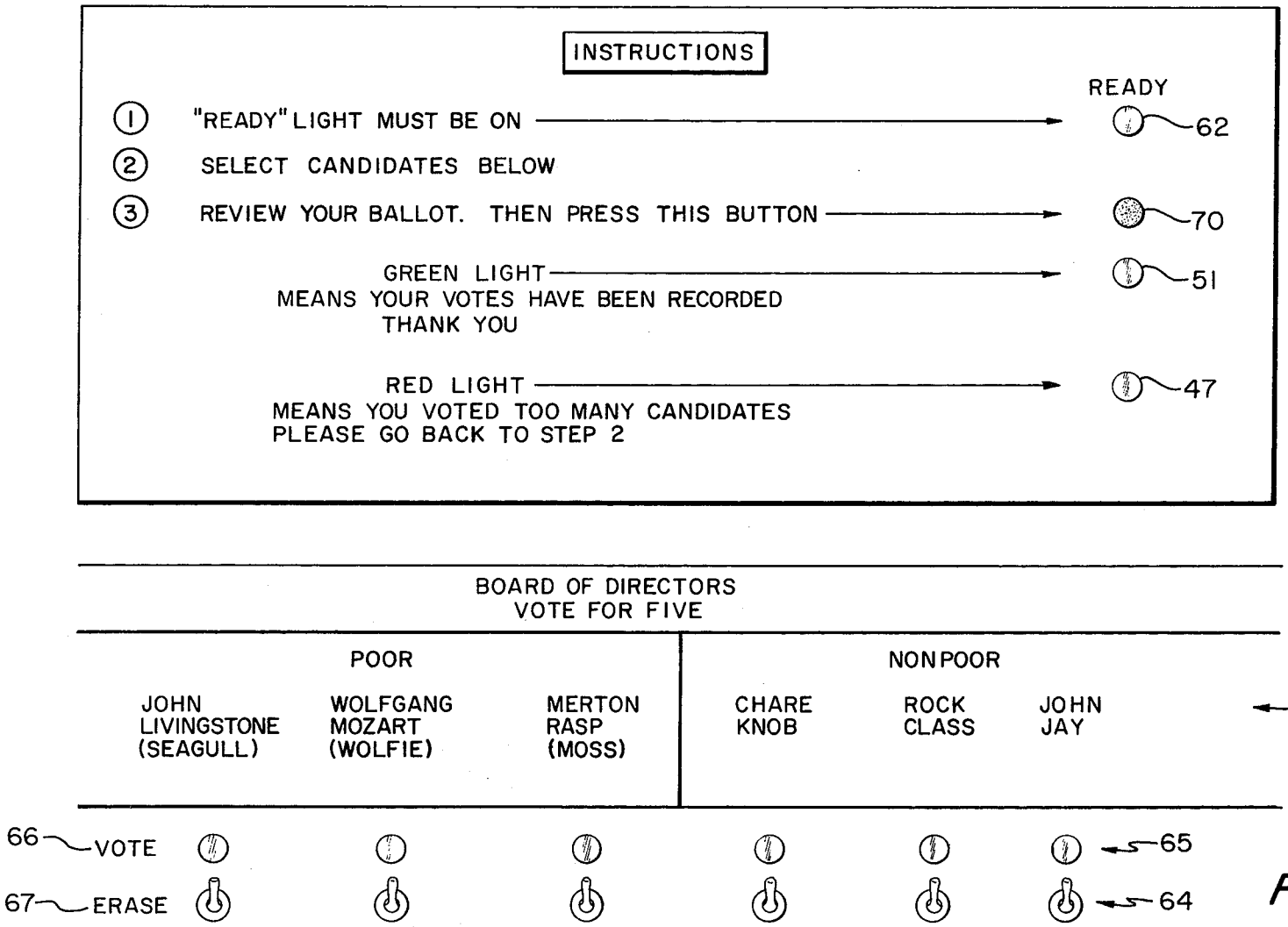
FIG. 2 is a pictorial representation of the front panel of the voting machine containing voter instructions, signal lights and voting switches.

With reference to FIG. 2, there is shown a representation of the face of the exemplary voting machine. In order to start voting ready light, 62 must be on to indicate that an election official has enabled the apparatus to receive vote selections from the voter then voting in a manner described below. In the specific example illustrated the machine is being used, for example, to select a board of directors for a poverty organization with there being six candidates 63 with each voter allowed to select a maximum of five from the three poor candidates and the three non-poor candidates. Each candidate is displayed immediately above a VOTE LIGHT 65 and a vote selection and erasure switch 64. Each candidate switch 64 is normally open in the center position and spring loaded to return to center when pushed up toward the vote position 66 and down to the erase position 67. Switches 64 may be of toggle or rocker type with momentary return to center from either direction.

When the voter has completed making his selections, he pushes button 70 to register his votes. If there is a valid number of selections; that is, one through five, green light 51 lights, and that voter can no longer vote. If the voter had made more than five or not made any selections, red light 47 lights, and the voter is instructed to go back to instruction 2.

Figure 3:
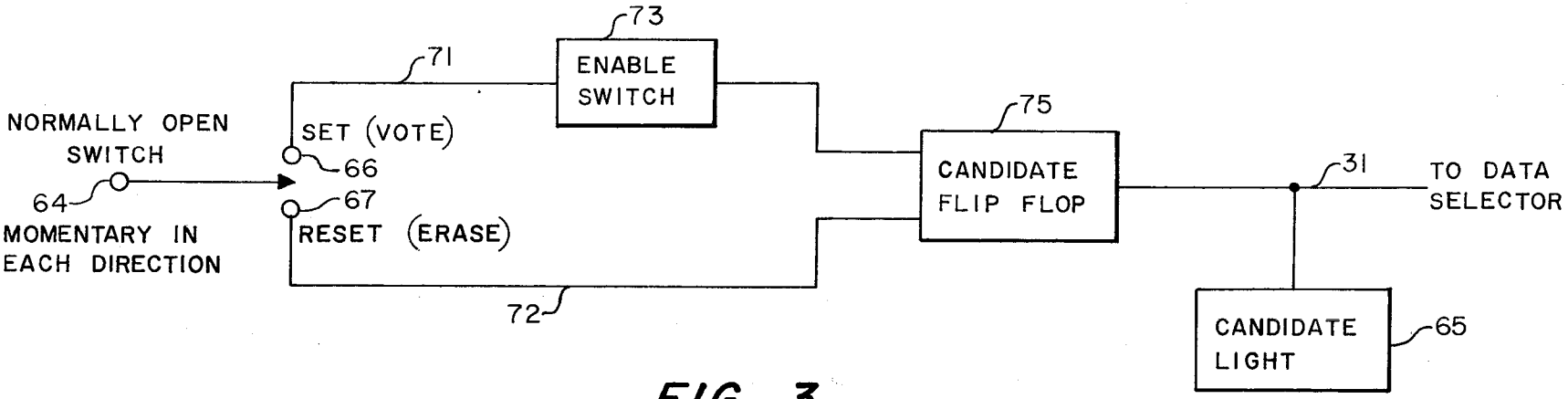
FIG. 3 is a diagram showing the relationship among a selection switch, candidate flip-flop, enable switch and candidate light.

Referring to FIG. 3, there is shown a combined schematic-block diagram illustrating the logical arrangement of a vote selection unit of vote selection mechanism 30. A switch 64 couples a source of setting or resetting potential (not shown) to the set or vote terminal 66 to deliver a set potential on line 71 that sets candidate flip-flop 75 or an erase potential on terminal 67 in the erase position over line 72 to reset candidate flip-flop 75 and extinguish candidate light 65 and remove the selection potential from line 31. An enable switch 73 is closed before the election when a switch is to be associated with a candidate and otherwise open so that actuating a switch not associated with a candidate in a particular election will not register a vote signal or illuminate a candidate light.

Figure 4:
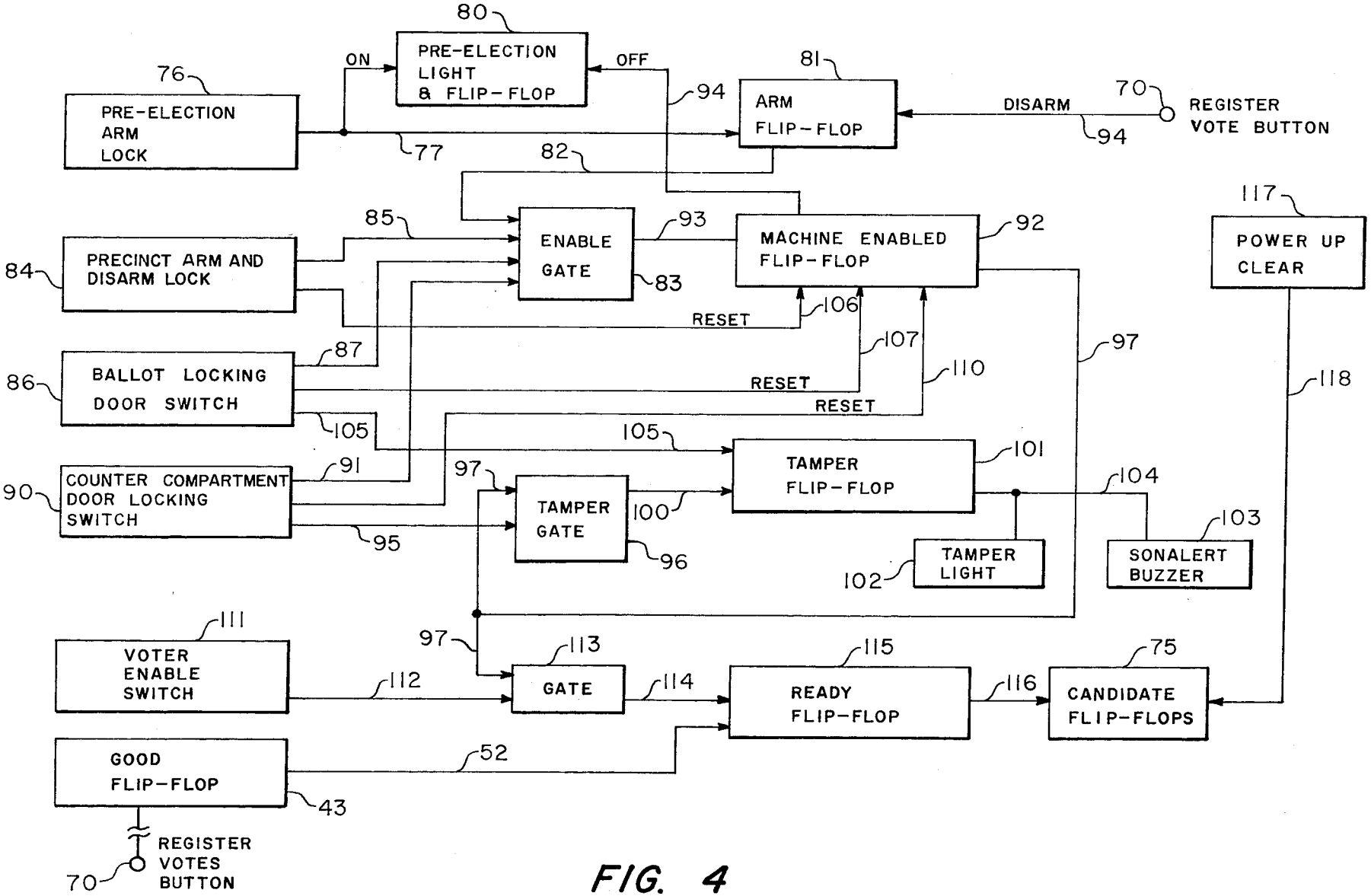
FIG. 4 is a block diagram illustrating the logical arrangement of devices for safeguarding against tampering.

Referring to FIG. 4, there is shown a block diagram illustrating the logical arrangmenet of certain elements in safety devices 54 and control logic 37 relative to certain other elements shown in FIG. 1 helpful in understanding the operation of the safety devices and control logic. Safety devices 54 and control logic 37 include various interlocks and related flip-flops that serve to deter tampering and make fraud and error easily detectable.

Pre-election arm lock 76 provides a signal on line 77 to illumiate pre-election light 80 by setting the associated flip-flop and set arm flip-flop 81 to indicate the machine is powered and that the pre-election arm lock is in the election set position. The output of arm flip-flop 81 then enables enable gate 83 which provides a set signal on line 93 to machine enabled flip-flop 92 when it also receives a signal on line 87 from ballot locking door switch 86 and on line 91 from counter compartment door locking switch 90 to indicate that the door to the counter compartment and the ballot plate are locked. Typically the machine is armed several days before the election by the machine technician in setting up the candidates, maximum number of available votes and which selection switches must remain disabled so that a local election official can enable the machine with the key for precinct arm and disarm lock 84.

A voter pressing register vote button 70 not only enables the register votes gate 29 to produce an initiate signal to data selector 32 as described above in connection with FIG, 1, but also provides a reset or disarm potential on line 94 that resets arm flip-flop 81 and disables gate 83 so that after the first vote has been cast, enable gate 83 will not enable the machine enabled flip-flop 92 even though the precinct official has the key to the precinct arm lock 84. Thus, the precinct official cannot stop the voting in the middle of the day and restart it. If he stops the machine, he must call the pre-election technician to restart it. When the machine enabled flip-flop 92 is set, it provides a signal on line 94 to turn off pre-election light 80 by resetting the associated flip-flop.

When the door to the center compartment is open, the associated switch 90 disables the enable gate 83 on line 91 and sends a signal on line 95 to tamper gate 96 which along with the signal on line 97 from machine enabled flip-flop 92 set the tamper flip-flop 101 on line 100. Tamper flip-flop 101 when set provides a signal on line 104 to light tamper light 102 and sound buzzer 103. Similarly tamper flip-flop 101 is set by a signal on line 105 from ballot locking door switch 86 when the ballot locking door opens.

Turning down the precinct arm lock resets the machine enabled flip-flop 92 on the line 106 to disable the machine and prevent further voting after the polls close. Opening the ballot locking door activates the door switch 86 to send a reset signal on line 107 to also disable the machine enabled flip-flop 92. Similarly, opening the counter compartment door activates the door switch 90 to send a reset signal on line 110 to also disable machine enabled flip-flop 92.

The local election official operates voter enable switch 111 to enable the apparatus to accept vote selections. Voter enable switch 111 then provides an enabling signal on line 112 of gate 113 having its other leg receiving an enabling signal on line 97 from machine-enabled flip-flop 92 when set. Gate 113 then provides a signal on line 114 that sets ready flip-flop 15 to provide an enabling signal on lines 116 that enables the candidate flip-flops 75 to receive and store vote selections. The result of this arrangement of apparatus is that no selections can be made until all the above safety conditions have been met. When register votes button 70 is pushed, good flip-flop 43, if activated, provides a signal on line 52 to disable ready flip-flop 115 and candidate flip-flop 75 and thereby prevent further selecting while votes are being registered on the candidate counter 61 and thereafter until a new voter is certified, and the precinct official reactivates the voter enable switch 111. A source of a power up clear signal 117 resets candidate flip-flops 75 on line 118 when the machine is initially turned on.

Figure 5:
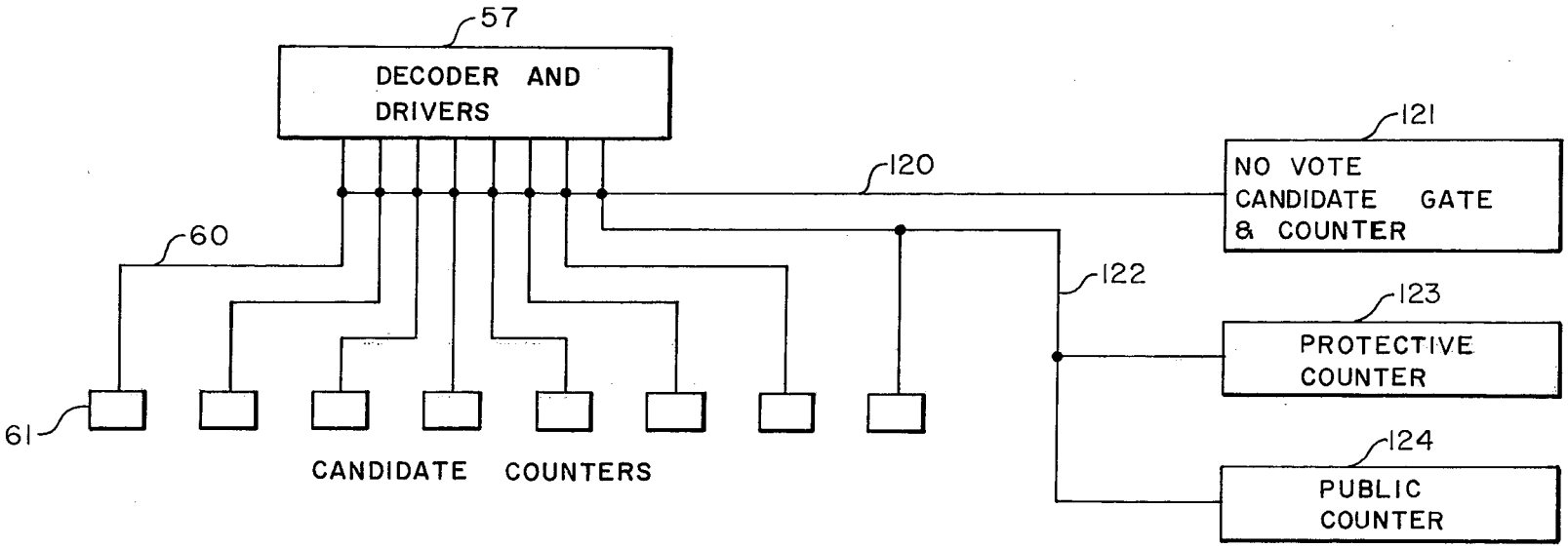
FIG. 5 is a block diagram illustrating various counters in a preferred form of the invention.

Referring to FIG. 5, there are shown three protective counter devices and their relationship to decoder and drivers 57 and candidate counters 61. Public counter 124 is reset to zero at the beginning of each election and incremented by signals on line 122 once for each voter. Protective counter 123 is preferably mounted in a sealed case, is also incremented by signals on line 122 once for each voter and records the total number of voters that have made selections on the particular machine. The no vote candidate gate counter 121 accepts inputs from each candidate counter signal on line 120 and stores the difference between the number of votes cast by a voter and the number of vote switches, providing a total of blank votes for the machine.

Figure 6A:
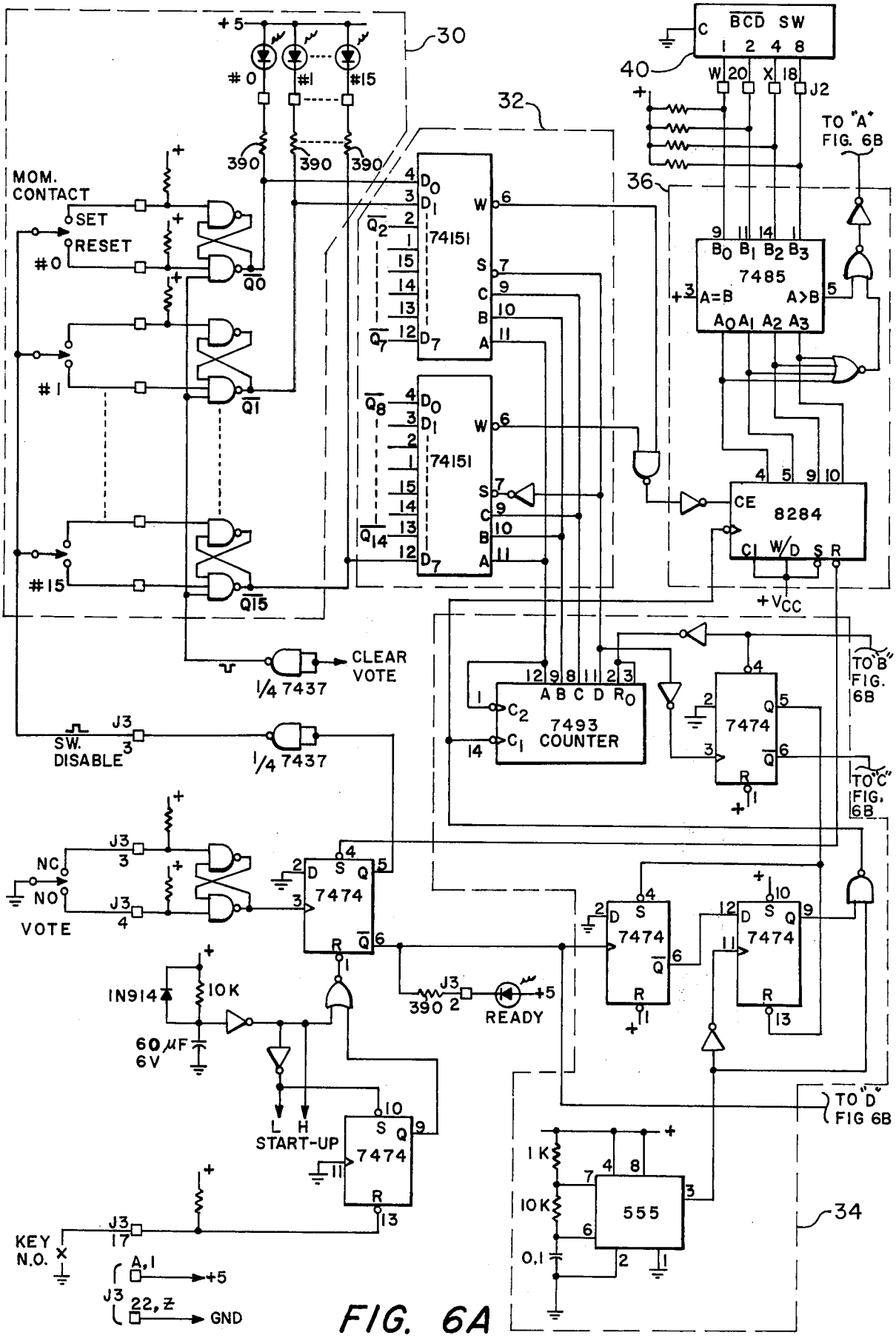
FIG. 6 is a circuit diagram of an exemplary embodiment of the invention with FIGS. 6A and 6B showing respective halves.
Figure 6B:
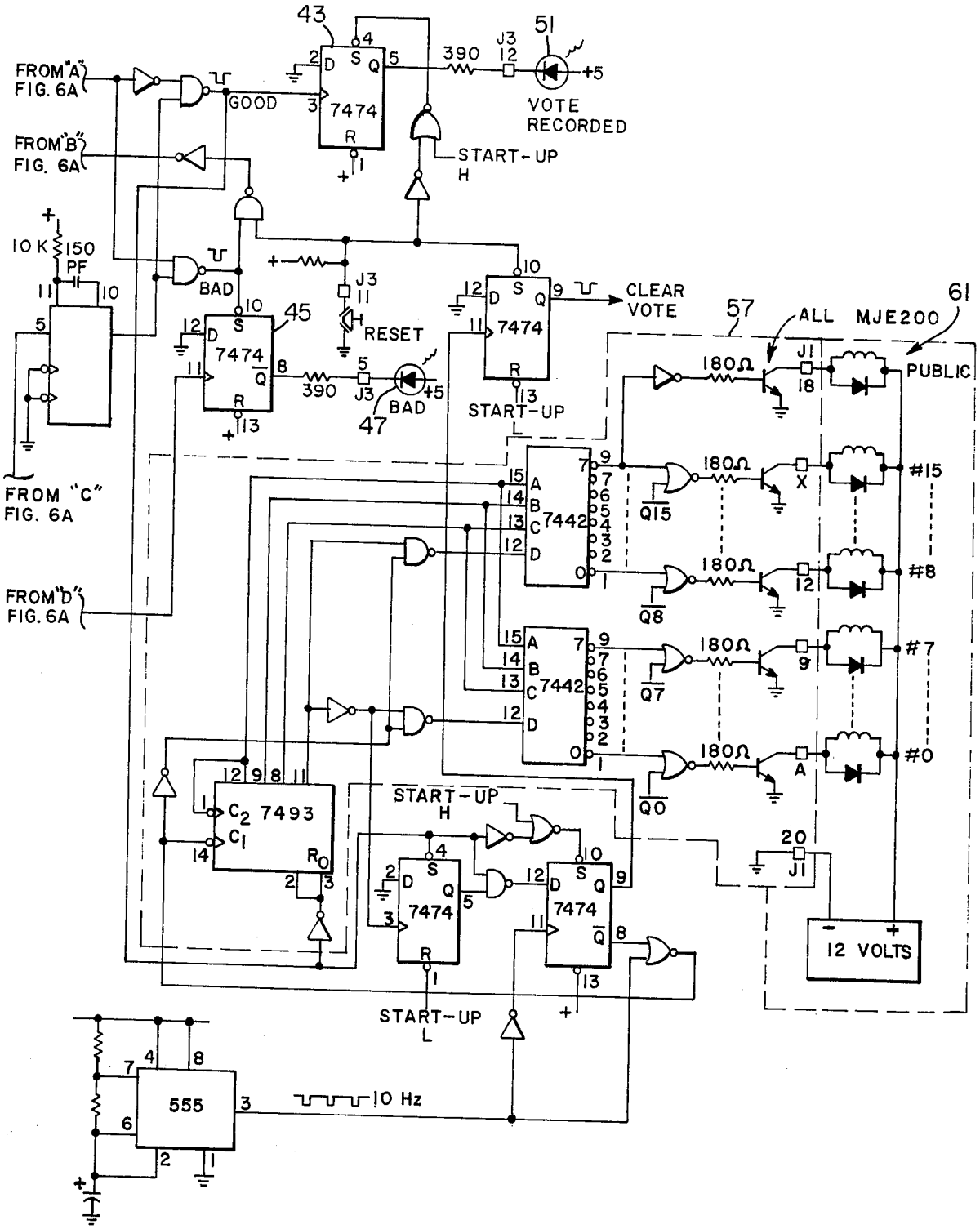

Referring to FIG. 6, there is shown a schematic circuit diagram of an actual embodiment of the invention which should enable those skilled in the art to build an actual working model of the invention. Where appropriate broken lines enclose components previously described as blocks in the block diagram. The various integrated circuits are identified, and the pull up resistors are 3.3 k ohms. The counters 61 are Veeder Root solenoid actuated counters that advance once for each pulse. Most of the elements outside the broken lines comprise control logic 37.

Basically this embodiment stores the selected votes as potentials that are effectively scanned in sequence with the multiplexers in data selector 32 to provide a number of pulses stored in up/down counter and logic 36 for comparison with the preselected number of votes established by BCD switch 40 to provide a good pulse that sets good flip-flop 43 and enables the decoder and drivers 57 to sequentially scan in sequence the states of the candidate flip-flops 75 to sequentially energize those solenoidal counters associated with a selected candidate and thereby advance the accumulated vote by one.

While the specific embodiment of the invention shows a separate counter for receiving a count representative of the number of votes cast by a voter and a comparator for comparing this stored count with the maximum number designated by BCD switch 40, it is within the principles of the invention to eliminate the separate comparator, arrange BCD switch 40 for entering the maximum count in the counter and having the vote pulses retard the maximum count in the counter and produce a bad signal when the count becomes less than zero.

There has been described novel apparatus and techniques for safety receiving votes in a relatively simple election with a compact portable electronic voting machine that is easy to operate by unskilled voters and election officials and may be set up by relatively unskilled technicians. It is evident that those skilled in the art may now make numerous uses and modifications of and departures from the specific embodiments described herein without departing from the inventive concepts. Consequently, the invention is to be construed as embracing each and novel feature and novel combination of features present in or possessed by the apparatus and techniques herein disclosed and limited solely by the spirit and scope of the appended claims.

What is claimed is:

1. Voting apparatus comprising, corresponding pluralities of bistable elements and vote selecting switches each associated with a candidate and having a vote position for registering a vote selection and an erase position for cancelling a previous vote selection coupled to an associated bistable element for storing the condition of selection, a corresponding plurality of candidate counter means associated with a respective vote selection switch for accumulating the votes cast in an election for a particular candidate associated therewith, vote registration switching means for actuation by a voter to cause the votes then selected by the voter for transfer to said candidate counter means, means for storing a number corresponding to the maximum number of votes a voter may cast in a particular election, means for sequentially scanning said bistable elements to provide a sequence of signals representative of the number of votes then cast by a voter and for effectively comparing the latter number with the number stored in said means for storing to provide a good signal in response to actuation of said vote registration switching means when that number is not exceeded by the maximum number there stored, means responsive to the occurrence of said good signal for preventing said vote selection switches from altering the state of said bistable elements, and means responsive to said good signal for transferring votes then stored in said bistable elements to corresponding ones of said output counter means.

2. Voting apparatus comprising, corresponding pluralities of bistable elements and vote selecting switches each associated with a candidate and having a vote position for registering a vote selection and an erase position for cancelling a previous vote selection coupled to an associated bistable element for storing the condition of selection, a corresponding plurality of candidate counter means associated with a respective vote selection switch for accumulating the votes in an election for a particular candidate associated therewith, vote registration switching means for actuation by a voter to cause the votes then selected by the voter for transfer to said candidate counter means, means for storing a number corresponding to the maximum number of votes a voter may cast in a particular election, means for sequentially scanning said bistable elements to provide a sequence of signals representative of the number of votes then cast by a voter and for effectively comparing the latter number with the number stored in said means for storing to provide a good signal in response to actuation of said vote registration switching means when that number is not exceeded by the maximum number there stored, means responsive to said good signal for transferring votes then stored in said bistable elements to corresponding ones of said output counter means, a blank counter for accumulating the number of blank votes, and means responsive to the occurrence of said good signal for advancing said blank counter by a number corresponding to the difference between said corresponding plurality and the number of votes transferred to said counting means.

3. Voting apparatus comprising, corresponding pluralities of bistable elements and vote selecting switches each associated with a candidate and having a vote position for registering a vote selection and an erase position for cancelling a previous vote selection coupled to an associated bistable element for storing the condition of selection, a corresponding plurality of candidate counter means associated with a respective vote selection switch for accumulating the votes cast in an election for a particular candidate associated therewith, vote registration switching means for actuation by a voter to cause the votes then selected by the voter for transfer to said candidate counter means, means for storing a number corresponding to the maximum number of votes a voter may cast in a particular election, means for sequentially scanning said bistable elements to provide a sequence of signals representative of the number of votes then cast by a voter and for effectively comparing the latter number with the number stored in said means for storing to provide a good signal in response to actuation of said vote registration switching means when that number is not exceeded by the maximum number there stored, means responsive to said good signal for transferring votes then stored in said bistable elements to corresponding ones of said output counter means, and tamper switch means for disabling said apparatus and preventing further voting when a predetermined door of said apparatus is opened at a predetermined time interval during the course of the election.

4. Voting apparatus in accordance with claim 1 wherein said means responsive to said good signal for transferring votes then stored in said bistable elements to corresponding ones of said output counter means includes means for sequentially transferring the votes then stored in said bistable elements to corresponding ones of said output counter means.

5. Voting apparatus in accordance with claim 4 and further comprising means responsive to actuation of said vote registration switching means and the sequence of signals representative of the number of votes then cast by a voter being greater than the maximum number stored in the means for storing to provide a bad signal.

6. Voting apparatus comprising, corresponding pluralities of bistable elements and vote selecting switches each associated with a candidate and having a vote position for registering a vote selection and an erase position for cancelling a previous vote selection coupled to an associated bistable element for storing the condition of selection, a corresponding plurality of candidate counter means associated with a respective vote selection switch for accumulating the votes cast in an election for a particular candidate associated therewith, vote registration switching means for actuation by a voter to cause the votes then selected by the voter for transfer to said candidate counter means, means for storing a number corresponding to the maximum number of votes a voter may cast in a particular election, means for sequentially scanning said bistable elements to provide a sequence of signals representative of the number of votes then cast by a voter and for effectively comparing the latter number with the number stored in said means for storing to provide a good signal in response to actuation of said vote registration switching means when that number is not exceeded by the maximum number there stored, means responsive to said good signal for transferring votes then stored in said bistable elements to corresponding ones of said output counter means, a voter enable switch for operation by an election official to provide a signal that enables a voter to vote, and logical circuit means responsive to actuation of said voter enable switch for establishing a ready to vote candidate that enables a voter to operate said vote selecting switches and cause his selections to be transferred to said output counter means upon actuation of said vote registration switching means, said logical circuit means being responsive to the occurrence of said good signal for terminating said ready to vote condition.

7. Voting apparatus comprising, corresponding pluralities of bistable elements and vote selecting switches each associated with a candidate and having a vote position for registering a vote selection and an erase position for cancelling a previous vote selection coupled to an associated bistable element for storing the condition of selection, a corresponding plurality of candidate counter means associated with a respective vote selection switch for accumulating the votes cast in an election for a particular candidate associated therwith, vote registration switching means for actuation by a voter to cause the votes then selected by the voter for transfer to said candidate counter means, means for storing a number corresponding to the maximum number of votes a voter may cast in a particular election, means for sequentially scanning said bistable elements to provide a sequence of signals representative of the number of votes then cast by a voter and for effectively comparing the latter number with the number stored in said means for storing to provide a good signal in response to actuation of said vote registration switching means when that number is not exceeded by the maximum number there stored, means responsive to said good signal for transferring votes then stored in said bistable elements to corresponding ones of said output counter means, pre-election arm lock means for actuation by a technician to the unlocked condition to provide a signal indicating that the apparatus has been properly set up for the election including storing the proper maximum number in said means for storing, precinct arm and disarm locking means for providing a signal for enabling said voting apparatus when operated by an election official when said pre-election arm locking means is in the unlocked condition, and means responsive to the occurrence of the first good signal thereafter for providing a signal that prevents further voting after said precinct arm and disarm locking means has been moved to the disarm condition until said pre-election arm locking means is again moved from the locked to the unlocked condition.

8. Voting apparatus in accordance with claim 7 and further comprising a voter enable switch for operation by an election official to provide a signal that enables a voter to vote, and logical circuit means responsive to actuation of said voter enable switch for establishing a ready to vote condition that enables a voter to operate said vote selecting switches and cause his selections to be transferred to said output counter means upon actuation of said vote registration switching means, said logical circuit means being responsive to the occurrence of said good signal for terminating said ready to vote condition.

* * * * *